US006623081B2

(12) United States Patent
Snyders

(10) Patent No.: US 6,623,081 B2
(45) Date of Patent: Sep. 23, 2003

(54) PLATEN FURNITURE

(76) Inventor: Mark Snyders, 4 Alexandria Parade, Coogee, NSW 2034 (AU)

( * ) Notice: Subject to any disclaimer, the term of this patent is extended or adjusted under 35 U.S.C. 154(b) by 0 days.

(21) Appl. No.: 10/258,422

(22) PCT Filed: Apr. 27, 2001

(86) PCT No.: PCT/AU01/00475

§ 371 (c)(1),
(2), (4) Date: Oct. 21, 2002

(87) PCT Pub. No.: WO01/82752

PCT Pub. Date: Nov. 8, 2001

(65) Prior Publication Data

US 2003/0057754 A1 Mar. 27, 2003

(30) Foreign Application Priority Data

May 1, 2000 (AU) ..... PQ7168
Aug. 5, 2000 (AU) ..... PQ9657
Feb. 22, 2001 (AU) ..... PR3277

(51) Int. Cl.[7] ..... A47C 7/02; A47C 15/00

(52) U.S. Cl. ..... 297/452.63; 297/280; 297/281; 297/284.4

(58) Field of Search ..... 297/273, 277, 297/280, 281, 284.1, 284.4, 452.63; 5/124, 125; 472/118, 125

(56) References Cited

U.S. PATENT DOCUMENTS

| | | | | | |
|---|---|---|---|---|---|
| 872,736 | A | * | 12/1907 | Lansberry, Jr. | 297/452.63 |
| 1,192,941 | A | * | 8/1916 | Schmid | 297/452.63 |
| 1,500,338 | A | * | 7/1924 | Shuman | 297/276 |
| 3,877,750 | A | * | 4/1975 | Scholpp | 297/284.3 |
| 4,244,622 | A | * | 1/1981 | Simpson | 297/273 |
| D281,206 | S | * | 11/1985 | Halsall | D6/347 |
| 4,608,798 | A | | 9/1986 | Spiers | |
| 5,788,327 | A | | 8/1998 | Gregory | |
| 5,957,536 | A | * | 9/1999 | Sullivan | 297/452.2 |
| 6,019,427 | A | | 2/2000 | Combest | |

* cited by examiner

*Primary Examiner*—Peter R. Brown
(74) *Attorney, Agent, or Firm*—Smith-Hill and Bedell

(57) ABSTRACT

A pendantly-supported swing chair has a mobile stand supporting a cross bar over which passes the upper ends of two parallel ropes. Each rope provides two upwardly extending portions which pass through, and hold in place at vertically-spaced positions, two rigid wooden support members. A bamboo platen has respective end areas providing an overhead sun screen supported by one pair of support members and a seat supported by the second pair of support members. The intermediate area of the screen provides a back rest and may be formed with a lumbar support. Arm rests movable to chosen positions on the ropes may be provided for comfort. Holes through which the ropes pass enable the heights of the seat and sun screen to be varied as well as their angles.

11 Claims, 3 Drawing Sheets

PLATEN FURNITURE

FIELD OF THE INVENTION

THIS INVENTION relates to furniture and is more specifically, but not exclusively, concerned with an article of furniture which may be transported as a compact kit and then quickly and easily erected at the site of use without having to connect the furniture together with locking fixtures such as nails or bolts.

STATE OF THE ART

Conventional rigid furniture is bulky and heavy and this makes transportation awkward and sometimes expensive. Various articles of furniture have been developed to reduce these disadvantages. For example, folding chairs and deck chairs are well known. Both use a base constructed from hinged plastics or wooden members which can usually be folded into a generally flat state so that the furniture can be transported in a fairly compact form.

A folded base still results in at least one pair of relatively large dimensions and the use of metal components to provide the hinging limits the materials from which the base can be made. Also, light materials, such as bamboo, do not lend themselves to being interconnected by metal standard-sized fixtures as bamboo splits easily and its radial dimension varies from one cane to another along its length. For these reasons, bamboo furniture is normally provided with a rigid base frame. The result is a relatively light article of furniture of pleasing appearance but it is usually bulky and its shape is unalterable so that it cannot be transported in a compact, easily erectable form.

OBJECT OF THE INVENTION

An object of this invention is to provide an article of furniture which is both light and compact to transport, and yet can be quickly and easily assembled when required for use.

THE INVENTION

In accordance with a first aspect of the invention, an article of furniture designed to be pendantly supported from above, comprises a platen of stiff, elongated elements spaced from one another and extending between opposite sides of the platen so that a line of slots extends along each of its side margins; flexible strands interconnecting the spaced elements allowing deformation of the platen out of its plane and into a desired shape; two, horizontally-spaced, seat-support members lying beneath respective side margins of the platen so that an area of its length rests on the support members to provide a seat; and, flexible connectors such as ropes, which can be arranged to extend down from one or more anchor fixtures above the furniture to the support members to carry the weight of the seat, sections of the connectors extending upwardly through selected side slots of the platen to hold it in position.

PREFERRED FEATURES OF THE INVENTION

Conveniently the elements are cylindrical, and hollow for lightness, and preferably comprise bamboo canes. These are stiff, light and pleasing in appearance. Also the natural interruptions in the cylindrical surface profile of a bamboo cane acts to hold the elements slightly apart in the platen so that air and light can pass between them. This facilitates cooling while allowing broken sunlight to pass through it to create an impression of airiness and coolness.

Suitably the elements in the platen alternate with parallel elements of shorter length, so that the marginal side edges of the platen are formed by the terminal portions of the longer elements. The gaps between the longer elements at the edges of the platen provide slots terminating on the ends of the shorter elements and which enable sections of a rope, providing the flexible connectors, to pass between them and so hold the platen in a particular desired shape. This shape can, for example, provide a lumbar back support. Preferably the strands holding the elements of the platen together are non-resilient rust-resistant wires which are manually deformable and are strong in tension.

The platen may be of an extended length. One-end portion of it may be draped over a pair of spaced, horizontal members which are preferably parallel but not necessarily so, to provide a seat for a swing chair. An intermediate portion of the platen can be used to provide a back support to the chair and a part of the back support may be arched forwards to provide a lumbar support of a desired shape to meet the comfort requirements of the user. The remaining end portion of the platen may be draped across another pair of spaced, parallel supports to provide an overhead screen for someone sitting in a swing chair. A feature of such a swing chair, is that the back support resiliently yields gently to a person leaning backwards in the chair to an extent dependent on the weight of the person. This gives a most comfortable feeling to the user.

Although the furniture outlined above is simple to assemble, it has a number of advantages over conventional furniture. Firstly, a person sitting on the furniture can readily adjust the height and angle of the seat, back support and overhead sun-screen to suit the user's particular requirements. This is achieved by altering the positions at which the support members are attached to the flexible connectors. Secondly, the surfaces of the platen which engage the user's body preferably comprise thin, spaced, part cylindrical portions of the elements and the spacing between them allows air to circulate through. The body surfaces of the person in contact with the platen are thus maintained cool when the chair swings back and forth, and the platen provides a very comfortable support for a person's body. A continuous, unventilated surface of a static conventional chair does not provide such ventilation and nor is it as comfortable, because in a hot climate, a person may often develop a hot damp zone in his clothing where it in contact with an unbroken surface of the chair, and which is caused by perspiration. This is avoided in the invention by the air flow passing through the platen as the chair swings gently back and forth. Finally, the spacing between the elements of the platen allow broken sunlight to pass between them when they are used to provide an overhead screen. The overall effect on a person sitting in a chair of the invention, is one of cool comfort. This is highly desirable in garden or leisure furniture particularly when intended to be used by elderly or physically-handicapped people.

INTRODUCTION TO THE DRAWINGS

The invention will now be described in more detail, by way of examples, with reference to the accompanying drawings, in which:

IN THE DRAWINGS

DESCRIPTION OF FIRST EMBODIMENT

Figure 1:
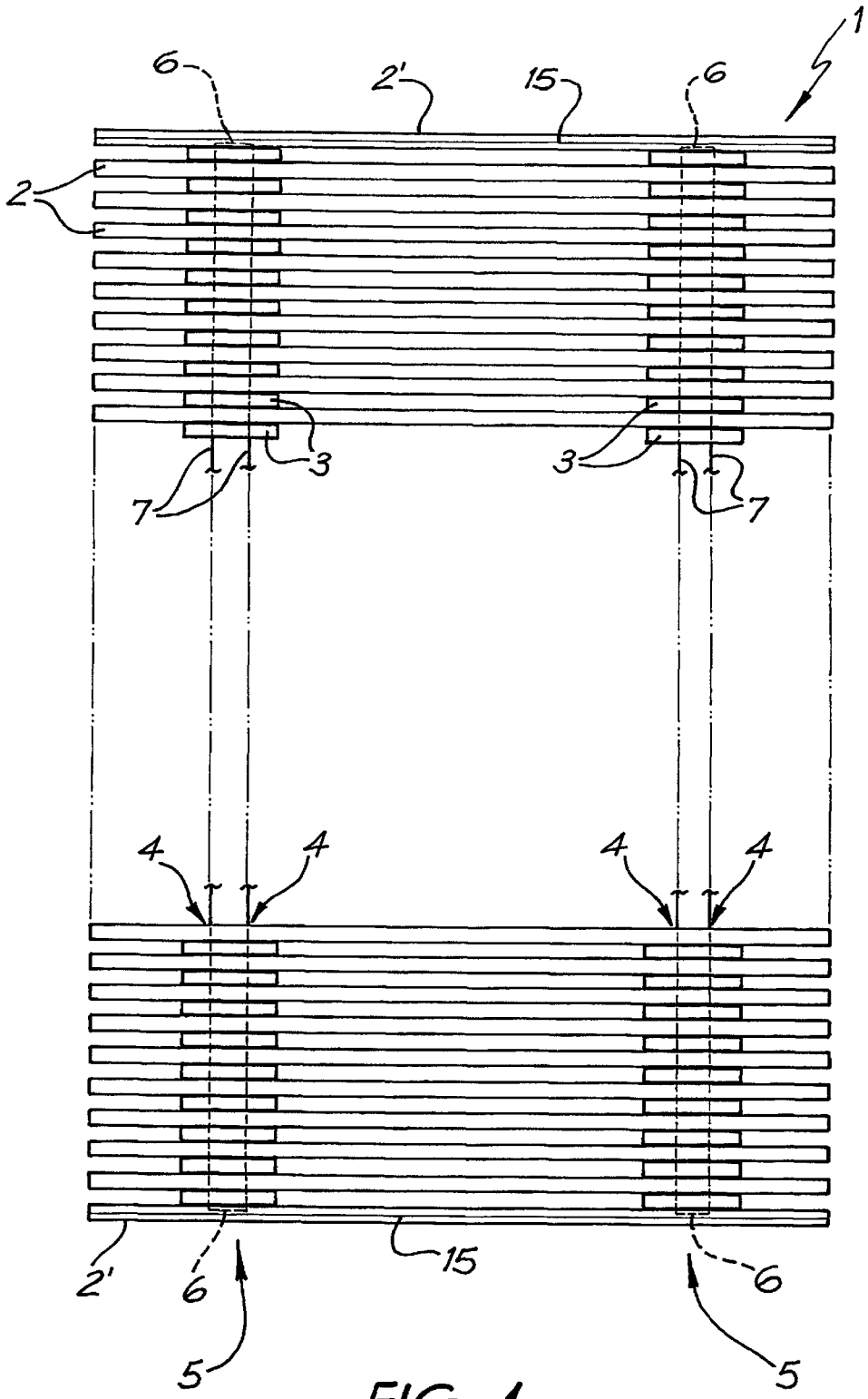
FIG. 1 is a plan view of a platen of parallel bamboo canes.

FIG. 1 shows a bamboo platen 1 composed of parallel straight tubular elements formed by bamboo canes 2 spaced from one another by pairs of aligned, shorter lengths of bamboo cane 3 of lesser diameter arranged in two columns 5. Each of the canes 2 and 3 is formed with pairs of aligned diametrically-extending holes 4. The shorter canes 3 act as spacers between the longer canes 2 and assist the ease with which the platen can be bent into a curve to suit a particular piece of furniture or screen. Strong stiffly-deformable but non-resilient wire strands 7 pass through the aligned holes 4 and each has its terminal portion secured inside the interior of one of two end canes 2' which respectively extend along one pair of opposite ends of the platen 1. The intermediate portion of the strand 7 is formed into a return bend 6 which may lie inside the interior of one of the end canes 2', as shown. The strands 7 are preferably resiliently tensioned.

Tensioning of a strand 7 may be achieved by having its return bend overlaying a resiliently flexible element, or, it may be tensioned by locating the tensioning element beneath the terminal connections made to the strand within the edge cane at the opposite ends of the platen. In some circumstances it may be preferred to locate resiliently flexible tensioning elements beneath the return bend of the strand and beneath the place where the strand end-portions are tied together.

Figure 3:
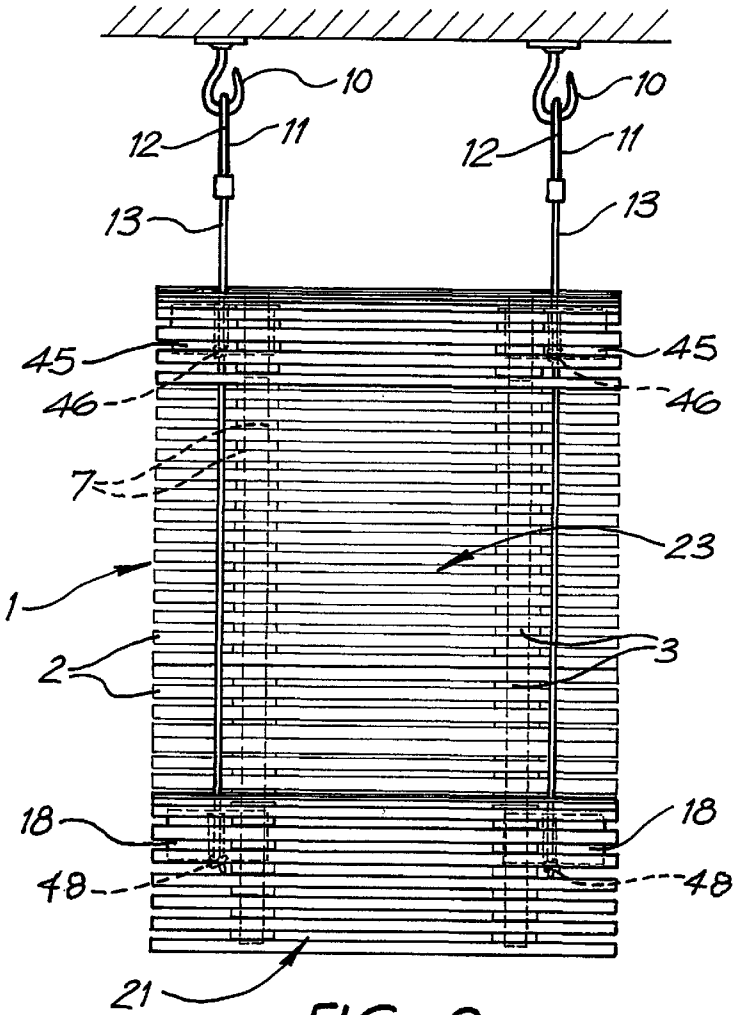
FIG. 3 is an end elevation of the swing chair of FIG. 2.
Figure 2:
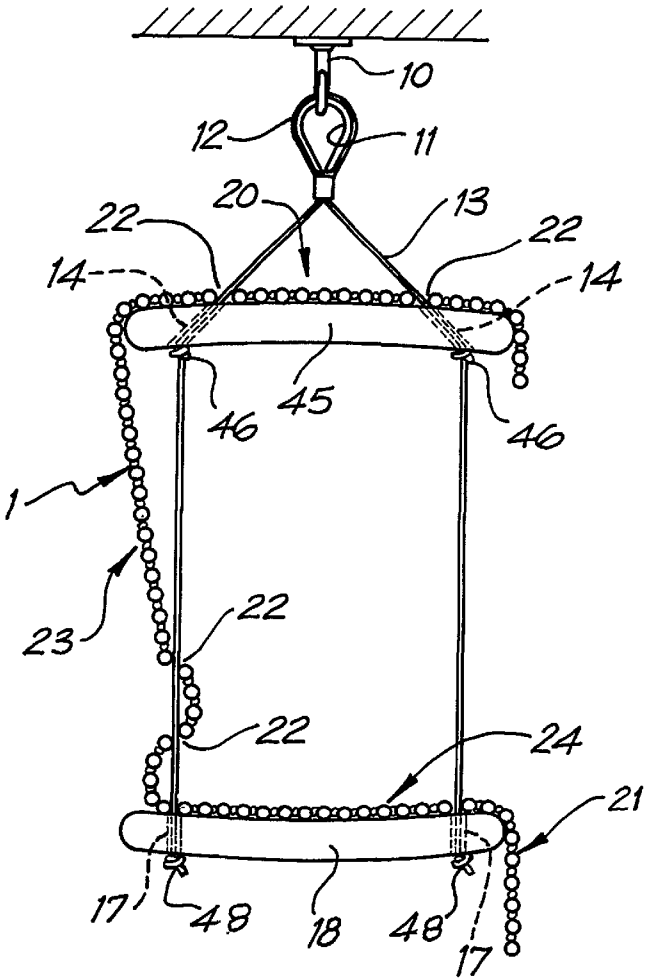
FIG. 2 is a side elevation of one form of swing chair incorporating the platen of FIG. 1.

FIGS. 2 and 3 show a pendant swing chair supported from overhead by means of an anchorage 10 provided by two metal hooks. Two stout ropes or fibre cords 13 provide flexible connectors and are formed with respective loops 12 which are held open by thimbles 11 towards their upper ends. The loops are hung from the hooks, as shown in FIG. 2. Opposite end-portions of each of the ropes 13 pass respectively through sloping bores 14 formed through a pair of spaced, parallel, wooden, upper support members 45. One pair of end-portions of the ropes 13 are knotted at 46 beneath the support members to hold them at a desired level beneath the anchorage 10 and with the desired spaced, parallel relationship as shown in FIG. 3. The knots may be made at any position to hold the support members 45 at any desired height or angle. Stops, not shown, movable along the ropes to different positions at which they may be fixed, may be used in place of the knots 46.

Opposite end-portions of each of the ropes 13 extend vertically downwards beneath the level of the respective knots 46 and pass through horizontally spaced vertical openings 17 formed in each of two lower wooden supports 18 which are also held in spaced parallel relationship. The terminal portions of the ropes 13 are knotted at 48 beneath the supports 18 to prevent the ropes 13 from being withdrawn upwardly through the openings 17. Once again moveable stops may be fixed to the ropes at chosen positions, in place of the knots. The ropes 13 thus hold the two lower supports 18 at the same level and spaced by a chosen distance from the upper supports 15.

An area 23 of the platen 1 extending upwardly between the two pairs of support members 45 and 18 provides a back support which may be deformed inwardly to provide a back lumber support as illustrated. The shape of the back support can be varied by adjusting one or both of the positions where the ropes 13 engage respective slots formed in the marginal side edges of the platen at the same level as denoted by the references 22.

As is shown in FIG. 2, the upper surface of each of the upper two supports 45 is convexly curved whereas the upper surface of each of the two lower supports 18 is concavely curved. This provides a slightly arched overhead sun screen, and slightly dished seat to the swing chair.

The platen 1 is fitted to the furniture as follows:

The platen 1 is first deformed manually at selected distances to enable its upper area 20 to be draped over the convex surfaces of the two parallel upper supports 45 and its lower area 24 to be draped over the concave surfaces of the two lower parallel supports 18.

The lower margin of the platen 1 hangs beneath the front edge of the lower supports 18 as shown at 21. The platen has its intermediate area 23 held in position by engaging the ropes 13 in selected slots formed along the two side edges of the platen between the canes of longest length. The lower area of the platen thus provides a dished seat for the swinging chair and the intermediate area 23 provides a back rest with a lumbar support of chosen shape which can be varied by altering the slots with which the ropes 13 are engaged. The upper area 20 of the platen 1 provides an adjustable sun screen to protect the head of someone sitting in the chair from direct unbroken sunlight. The back support yields resiliently when someone sifting in the chair leans backwards, the extent of yielding being a function of the weight of a person sitting in the chair.

The above-described pendant swinging chair is easily and quickly erected by the user and can be readily adjusted. It also can be transported in a light and compact form by placing the supports 45 and 18 together, and then wrapping the ropes 13 around them. The platen 1 can then be wrapped around the supports 45 and 18 to complete the package. If the user wishes to alter the positions or vertical spacing beneath the pairs of upper and lower supports 45 and 18, or alter their inclination to the horizontal, this can be achieved by altering the positions of the knots 46, 48 holding them in place. Alternatively, stops which are movable along the ropes can be provided, the stops having, releasable fixtures for securing them to chosen positions on the ropes 13.

It will be appreciated that the width of the platen can be varied to provide a two or three seater pendant chair and the number of and lengths of the columns 5 of short rods or cane 3 which hold the longer canes 2 apart, can be increased as required to provide the required, strength.

DESCRIPTION OF SECOND EMBODIMENT

Figure 5:
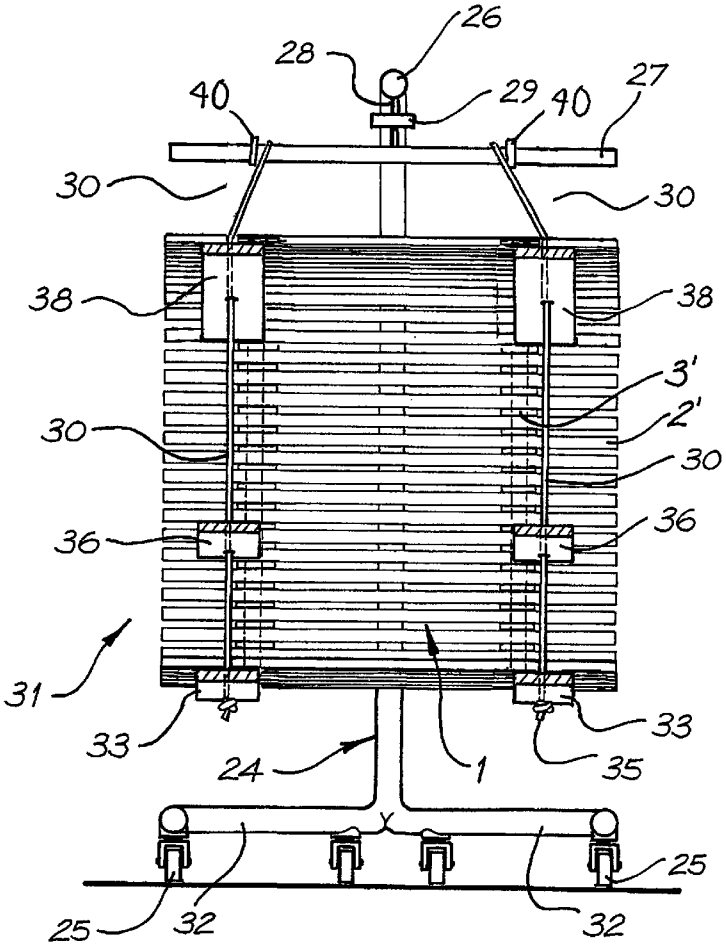
FIG. 5 is an end elevation of the swing chair of FIG. 4.
Figure 4:
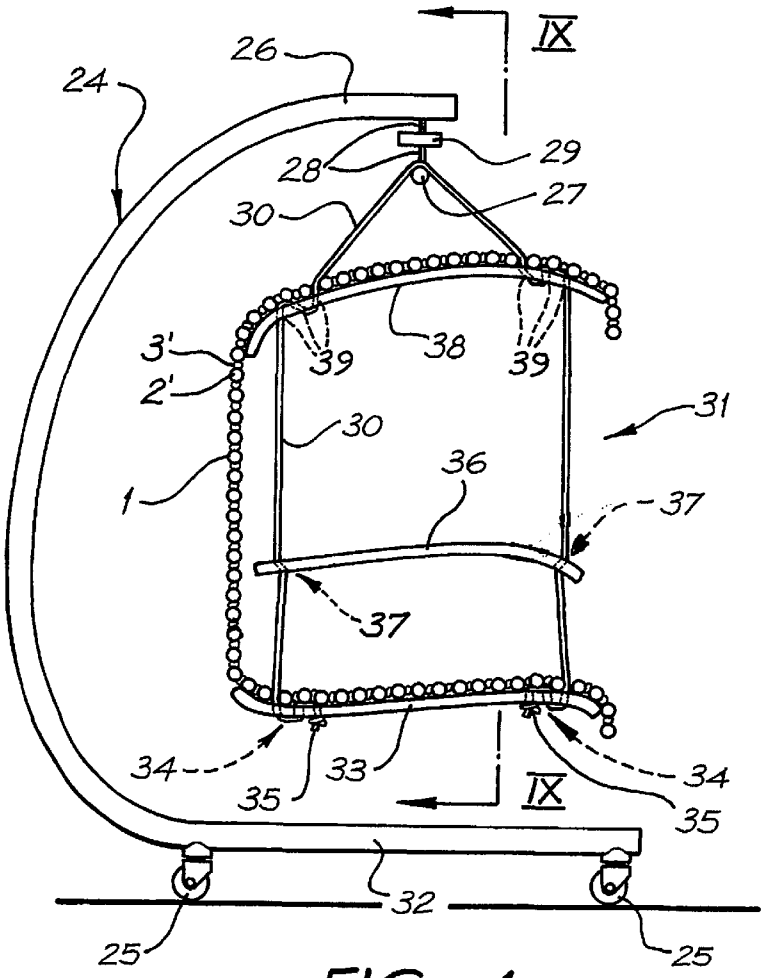
FIG. 4 is a side elevation of a second form of swing chair.

FIGS. 4 and 5 shows a mobile, upright, stand 24 mounted on castors 25 and having an upper arm 26 which pendantly supports a cross-bar 27 by way of aligned pivot bolts 28 and a horizontal turning mechanism 29. The cross-bar 27 is provided with spaced abutments 40.

Two, strong parallel ropes 30 are respectively looped over opposite end portions of the cross-bar 27 behind the abutments 40, and diverge downwardly to support a swinging chair 31 above the lower part of the stand which is bifurcated to provide two divergent limbs 32 providing a stable base for the stand 24.

The chair 31 comprises a bamboo platen 1 of the form described earlier with reference to FIG. 1. The platen 1 has its lower area draped over a pair of spaced parallel support members 33 made from suitably-shaped, wooden flat strips which are strong and durable. The strips 33 are formed towards their opposite ends with sets of three spaced holes 34 allowing the lower end portions of the ropes 30 close to one marginal edge of the platen 1 to be threaded through them to retain the supports in a chosen position. The free ends of the ropes may be knotted beneath the supports 33, as shown at 35, although this is not essential as the rope will not normally slip through the holes 34.

The ropes 30 ascend upwardly from the supports 33 so that they pass through slots formed between the longer parallel bamboo canes 2' at the sides of the platen 1 immediately above the supports 33. The shorter bamboo canes 3' arranged between the longer ones, provide with their ends abutments to prevent the ropes 30 sliding, over a period of time, towards the centre of the bamboo platen 1. The ropes 30 also serve to hold shaped arm-rests 36 in place above the supports 33. The arm-rests 36 are made of wooden strip and are retained in position by having the ropes 30 pass upwardly through respectively complementary holes 37 arranged towards opposite end-portions of the arm-rests 36. The holes 37 are drilled at an angle to the vertical so that the ropes 30 passing upwardly through them to provide for adjustment. The ropes bite into the corners of the holes 37 to resist unwanted vertical sliding movement of the ends of the arm-rests down the rope, under the weight of the arms of a person sitting in the chair, so that the armrests remain in the positions to which they have been adjusted.

After passing through the holes 37 the ropes ascend upwardly to two spaced parallel upper supports 38 also made of wooden strips and which are shaped, as shown, to guide and support the upper portion of the platen 1 over the head of a person sitting in the chair. Each support 38 is provided towards each of its end-portions with a respective set of three spaced holes 39 to allow the rope to be threaded in turn through them. This prevents relative unintended movement occurring between the rope 30 and the upper supports 38. This form of connection allows the height of the upper and lower supports 38 and 33 to be adjusted, as required, in height and inclinations, without the use of knots or stops.

The intermediate portions of each of the ropes 30 passes upwardly and around the portion of the cross-bar 27 lying between the two abutments 40.

The swinging chair of FIGS. 4 and 5 requires for its construction, apart from the stand 24, only the platen 1, two ropes 30, the four strips of wood forming the two pairs of supports 33 and 38, and the arm rests 36. It is quick and easy to erect, and is fully adjustable, and reliable and safe to use. It is also comfortable, airy and cool, and can be adjusted to suit different postures by altering the positions of engagement of the ropes with the supports.

MODIFICATIONS TO THE CHAIRS DESCRIBED

The chair of each of the embodiments can be made in different sizes and may be made from stiff coloured plastics hollow tubular elements, or solid elements, instead of bamboo. This gives it a more colourful appearance and thus makes it more attractive to children when made to a smaller size to suit a child. Also, the elements may have a cross-section other than circular.

The platen can be made in any length according to the size and strength of the bamboo canes or other elongated elements used for the construction of the platen.

What is claimed is:

1. An article of furniture designed to be pendantly supported from above, comprising a platen of stiff, elongated elements spaced from one another and extending between opposite sides of the platen so that a line of slots extends along each of its side margins; flexible strands interconnecting the spaced elements allowing deformation of the platen out of its plane and into a desired shape; two, horizontally-spaced, seat-support members lying beneath respective side margins of the platen so that an area of its length rests on the support members to provide a seat; and, flexible connectors such as ropes, which can be arranged to extend down from one or more anchor fixtures above the furniture to the support members to carry the weight of the seat, sections of the connectors extending upwardly through selected side slots of the platen to hold it in position.

2. An article of furniture as claimed in claim 1, in which an overhead sun screen is provided by a second area of the platen draped over a second pair of horizontally-spaced support members which are also carried by the connectors, the second area being held in place by having the connectors passing through selected slots in its side margins.

3. An article of furniture as claimed in claim 1, in which a flexible back support is provided by an area of the platen extending upwardly from the back of the seat and held in position by the passage of the connectors through selected slots in the side margins of the platen.

4. An article of furniture as claimed in claim 3, in which a flexible lumbar support is provided by bulging forwards a section of the area of the platen providing the back support, the profile of the lumbar support being held by passing the connectors through selected slots in the side margins of the platen.

5. An article of furniture as claimed in claim 1, in which the spacing between the elements of the platen is achieved by locating spacing elements between them, the spacing elements terminating at their ends short of the sides of the platen so as to provide with their ends the bottoms of the slots extending along the side margins.

6. An article of furniture as claimed in claim 5, in which the strands holding the elements of the platen together comprise stiff, relatively inextensible wires which are flexible to allow the platen to be deformed into a desired shape and thereafter assist in retaining that shape.

7. An article of furniture as claimed in claim 6, in which the wires pass through diametrically-extending holes formed through the elements which are cylindrical in shape.

8. An article of furniture as claimed in claim 5, including a cross-bar for positioning above the article and for supporting the upper ends of the flexible connectors, abutment surfaces being provided on the cross-bar for preventing movement of the flexible connectors towards the respective ends of the cross-bar, the spacing between the abutment surfaces being less than the spacing between the remote ends of the spacing elements so that the flexible connectors diverge from one another as they extend down from the cross-bar towards the upper end of the article.

9. An article of furniture as claimed in claim 1, in which the elements comprise bamboo canes and the flexible connectors comprise sections of rope of approximately the same diameter as the widths of the side slots through which they pass.

10. An article of furniture as claimed in claim 1, having arm rests for locating above the seat and having inclined slots through which the flexible connectors can be threaded to hold the arm rests in a selected position.

11. An article of furniture as claimed in claim 1, provided as a kit of parts with instructions for assembling them together to provide the article.

* * * * *